US009617736B2

(12) United States Patent
Zhou

(10) Patent No.: US 9,617,736 B2
(45) Date of Patent: Apr. 11, 2017

(54) CLAMPING SYSTEM FOR MOUNTING GLASS BALUSTRADE

(71) Applicant: Danes Zhou, Qingdao (CN)

(72) Inventor: Danes Zhou, Qingdao (CN)

( * ) Notice: Subject to any disclaimer, the term of this patent is extended or adjusted under 35 U.S.C. 154(b) by 0 days.

(21) Appl. No.: 14/252,896

(22) Filed: Apr. 15, 2014

(65) Prior Publication Data

US 2015/0267415 A1 Sep. 24, 2015

(30) Foreign Application Priority Data

Mar. 21, 2014 (CN) ..... 2014 1 0108718

(51) Int. Cl.
*E04F 11/18* (2006.01)

(52) U.S. Cl.
CPC ..... *E04F 11/1817* (2013.01); *E04F 11/1812* (2013.01); *E04F 11/1853* (2013.01)

(58) Field of Classification Search
CPC . E04F 11/181; E04F 11/1817; E04F 11/1851; E04F 11/1853
See application file for complete search history.

(56) References Cited

U.S. PATENT DOCUMENTS

| | | | | |
|---|---|---|---|---|
| 6,419,209 | B1 | 7/2002 | Shepherd | |
| 2010/0307082 | A1 * | 12/2010 | Nash | E04F 11/1851 52/238.1 |
| 2013/0240814 | A1 | 9/2013 | Bangratz | |

FOREIGN PATENT DOCUMENTS

| | | | | |
|---|---|---|---|---|
| CN | 202627361 U | | 12/2012 | |
| DE | 2 02013 100 585 | * | 2/2013 | F16B 2/14 |
| DE | 202013104330 U1 | | 12/2013 | |
| DE | 20 2012 104 033 | * | 1/2014 | E04F 11/1812 |
| EP | 1818476 A1 | | 8/2007 | |
| FR | 2 930 270 A1 | * | 10/2009 | E04F 11/1851 |
| FR | 2930270 A1 | | 9/2013 | |
| WO | WO 2013/121330 | * | 8/2013 | E04F 11/18 |

* cited by examiner

*Primary Examiner* — Michael P Ferguson
(74) *Attorney, Agent, or Firm* — Michael D. Eisenberg

(57) ABSTRACT

The present invention relates to a clamping system for mounting glass balustrade, which includes a base with a U-shaped channel, an adjusting component A and an adjusting component B. The adjusting component A comprising: an L-shaped Plate with an arc groove inside, fitting for an arc panel; an arc panel with longer arc-length than that of the arc groove in the L-shaped Plate. The adjusting component B comprising: a supporting plate with a trapezoid groove inside; a wedge A, a wedge B and an adjusting bolt; a hole channel on the middle top of the supporting plate, reaching through the trapezoid groove with a locating element in the middle; both the wedge A and the wedge B, with one plane side and another bevel side, as single-side wedge structure; a threaded hole in the middle of the wedge A, which has internal thread matching with the adjusting bolt; the adjusting bolt, with top part screwing through the threaded hole of the wedge A, with the bottom part connecting with the wedge B; an embossing belt A on the two bevel surfaces of the trapezoid groove, paralleling to the center line of the trapezoid groove, symmetrical about the center line. The present invention can be easily dismounted, as well as allowing the angle of the glass changeable.

10 Claims, 11 Drawing Sheets

CLAMPING SYSTEM FOR MOUNTING GLASS BALUSTRADE

CROSS-REFERENCES TO RELATED APPLICATIONS

The present application claims priority under the Paris Convention to Chinese application number CN 201410108718.2, filed on Mar. 21, 2014, the disclosure of which is herewith incorporated by reference in its entirety.

TECHNICAL FIELD

The present invention belongs to the technical field of balustrade fittings, in some embodiments thereof, relates to a clamping system for mounting glass balustrade.

BACKGROUND OF THE INVENTION

The frameless glass balustrade enjoys a modern, simple and attractive appearance, and is widely applied to architectural fence. In general, two methods are employed to fix the present frameless glass balustrades. In one of the method, a U shaped channel is utilized in order for the fixing. The opening of the U shaped channel is of a fixed value, but for different glass panes with different widths, the widths of channel may vary. In this way of fixing, several defects are founded: 1. lack of popularity; 2. lack of ability to resist pushing force, difficulties of installing and the increase of cost for thickening the steel plate of the U-shaped channel to enhance the push-resist strength; 3. strict angle demanding and difficulty of adjusting the glass after installation. While in the other method, the channel is strictly dug into the floor, into which the glass pane is inserted and the glue is injected. There are also some defects in this way: 1. more workload for digging the channel; 2. difficulties of changing the glass pane; 3. Constrains imposed by the floor, some inadmissibility of fluting or drilling.

In recent years, with the higher demands for artistic permeability of construction design, the glass balustrades are usually designed to be merely fixed at the bottom, with one side impending. In this case, it is very difficult to change the angle in the conventional two-sided manual adjusting way.

The utility model patent CN 201809915 U discloses an aluminum alloy frameless balustrade and a partition fixing system thereof. The plate fixing system includes a fixing base and an adjustable pushing base, which are fixed and connected by fasteners and making up a partition receiving part. Steel bars can be fixed into the base, while threaded holes can also be fixed on the steel bars. The fixing base and the adjustable pushing base can have through-holes respectively, and the fasteners can be the locking bolts, which stick through the through-holes of the fixing base and the adjustable pushing base and screw into the threaded holes on the steel bars. This structure is of good popularity, with no need to match the different fixing systems with glasses of different widths. But on the other hand, the structure is complex and thus inconvenient for installation. Most important is that, this structure cannot meet the demands of adjusting the angle of the glass. Besides, it cannot be easily dismounted, because of the glue injected in the late period.

The U.S. Ser. No. 14/058,337 discloses a concealable clamping system for mounting partitions, comprising: a base with an opening to receive an edge portion of a partition; at lease one receiving plate fitted inside of the opening of the base to orient the edge portion of the partition; at least one adjustable wedge to secure the edge portion of the partition against the receiving plate and against an inner surface of the base; a first removable concealing strip fitted between a first edge of the base and the partition; and a second removable concealing strip fitted between a second edge of the base and the partition.

BRIEF SUMMARY OF EMBODIMENTS OF THE INVENTION

In order to solve the prior technical problems, the invention discloses a new clamping system which can be easily dismounted, as well as allowing the angle of the glass changeable.

The technical scheme of the invention is as below: a clamping system for mounting glass balustrade, including a base with a U-shaped channel, an adjusting component A and an adjusting component B. The adjusting component A comprising: an L-shaped Plate with an arc groove inside, fitting for an arc panel; an arc panel with longer arc-length than that of the arc groove in the L-shaped Plate. The adjusting component B comprising: a supporting plate with a trapezoid groove inside; a wedge A, a wedge B and an adjusting bolt; a hole channel on the middle top of the supporting plate, reaching through the trapezoid groove with a locating element in the middle; both the wedge A and the wedge B, with one plane side and another bevel side, as single-side wedge structure; a threaded hole in the middle of the wedge A, which has internal thread matching with the adjusting bolt; the adjusting bolt, with top part screwing through the threaded hole of the wedge A, with the bottom part connecting with the wedge B; an embossing belt A on the two bevel surfaces of the trapezoid groove, paralleling to the center line of the trapezoid groove, symmetrical about the center line.

In another variant, the adjusting component A further comprises a slide-way situated on both sides of the arc groove in the L-shaped plate of the adjusting component A and a slot B located beside each end of the slide-ways; a sliding block in the middle of both sides of the arc panel, which matches with the slide-way; insert plates fitting for slots B, making the L-shaped plate and the arc panel jointly held together by inserting into the slot. The arc panel embedded into the L-shaped plate can slide up and down freely, without the sliding away from the arc groove.

In still another variant, the Wedge B comprises a slot in the middle of the bottom part and the adjusting bolt comprises a blocking foot at the end, which fits with the slot, connecting with the wedge B by assembling the blocking foot and the slot.

A hexagonal hole is buried on the top of the adjusting bolt.

Two supporting-feet are configured at the bottom of the supporting plate.

A steel panel is installed at the bottom of the slot to enhance the strength.

In yet another variant, the locating element has a groove, of which the interspace is slightly bigger than the outer diameter of the adjusting bolt, where the adjusting bolt is put in. On one hand, the locating element can fix the adjusting bolt and prevent the adjusting bolt from moving left and right. On the other hand, it can also avoid the contact of the wedge A and the wedge B, if one of them locks and the other one keeps moving, during their opposite movement.

And the principle of the anti-lock function of the locating element is as below: the locating element is situated in the middle of the trapezoid groove, and during the opposite movement of the wedge A and the wedge B, in condition that the wedge B is blocked due to the force of friction, the wedge A moves downwards some distance until it meets the locating element and the wedge A stops moving, then the wedge B moves upwards by the action of adjusting bolt, therefore the wedge B unlocks; another condition is that when the wedge A is blocked due to the force of friction, the wedge B moves upwards some distance until it meets the locating element and stops moving, then the wedge A moves downwards by the action of the adjusting bolt, therefore the wedge A unlocks.

The bottom of the L-shaped plate has a drain hole for drainage.

The bottom of the L-shaped plate is configured an arc embossing belt B, which can facilitate the slide of the glass bottom on the L-shaped plate during angling the glass.

A friction tape inside of the arc groove of the L-shaped plate, elastic elements on both sides of the friction tape in the arc groove, flutes on the back of the arc panel matching with the elastic elements.

When installing the glass balustrade, the adjusting component A is put into the fixed U-shaped channel, making the L-shaped plate against the wall of the U-shaped channel. Then the glass is put inwards, making the glass against the plane surface of arc panel completely. Then the magnet and the magnetic spirit level are attached to each side of the glass for the use of observing the horizontal plane. The glass is angled to keep vertical with horizontal plane, by the measure of sliding the arc panel which is clung to the glass in the arc groove.

After angling, the adjusting component B is put inside. By wresting the wrench and making the adjusting bolt rotated clockwise, the wedge A and the wedge B make backwards movement, and then the thickness of the adjusting component B is enhanced till it can fasten the glass. The wedge A and wedge B only contact with the embossing belt A on the bevel surface of the trapezoid groove, therefore the pressure from the wedge A and wedge B during their moving can only apply to the embossing belt A which located symmetrically with the center line of the trapezoid groove. During the backwards movement of wedge A and wedge B, the force point doesn't change with the movement of wedge A or wedge B, and thus it can guarantee the force delivered from the glass to the arc panel keeping balance, which can prevent the arc panel from sliding due to the asymmetrical force bearing.

When dismounting of the glass balustrade, by twisting the adjusting bolt anticlockwise, the wedge A and the wedge B make the opposite movement, and then the thickness of the adjusting component B is reduced to unfix and release the glass.

The invention has the beneficial effects are that: 1. the invention is simple-structured and easy to dismount; 2. the adjusting component A and adjusting component B have large contacting area with the glass, thus the clamping is stable and the pressure is well-distributed; 3. by angling the glass through the arc panel, the error aroused by the uneven of the floor is eliminated, making the glass vertically installed which is fastened by the wedge structure; 4. the glass can be fastened and angled only at one side, which increases the working efficiency, especially on the condition that the glass balustrade is impending settled, therefore it is more convenient for application

BRIEF DESCRIPTION OF THE DRAWINGS

The present invention, in accordance with one or more various embodiments, is described in detail with reference to the following figures. The drawings are provided for purposes of illustration only and to merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
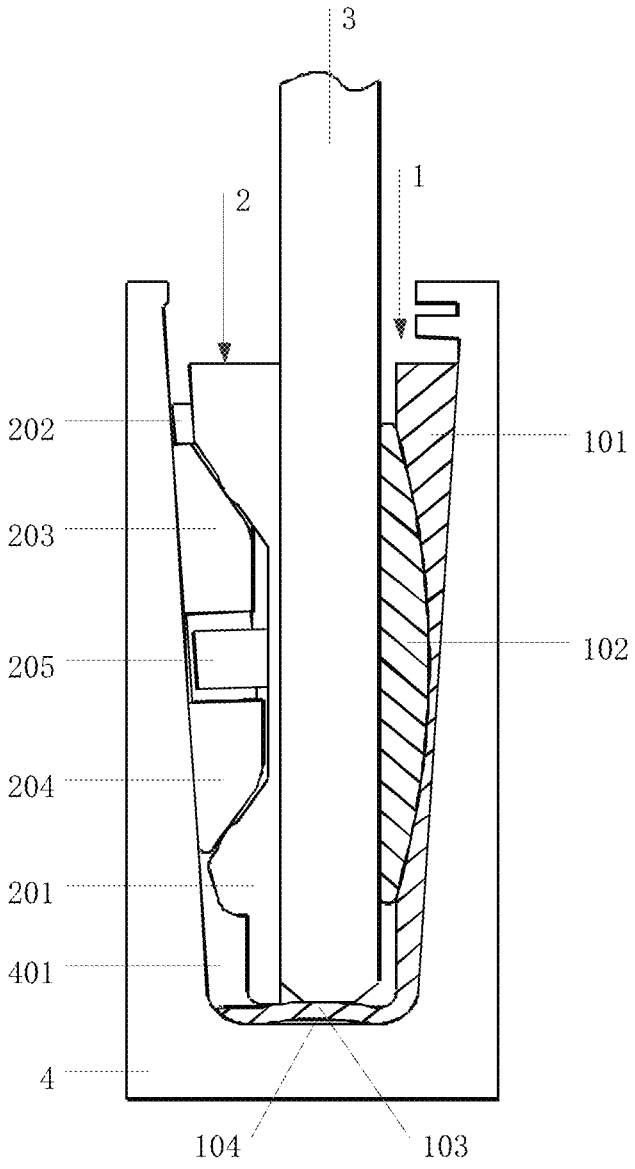
FIG. 1 is the schematic illustration, according to some embodiments of the present invention.

Hereinto:

1 the adjusting component A
2 the adjusting component B
3 the glass
4 the base
5 the hexagon wrench
101 the L-shaped plate
102 the arc panel
103 the arc embossing belt B
104 the drain hole
105 the slide-way
106 the sliding block
107 the slot B
108 the insert plates

109 the arc groove
110 the elastic elements
111 the friction tape
112 the flutes
201 the supporting plate
202 the adjusting bolt
203 the wedge A
204 the wedge B
205 the locating element
206 the hole channel
207 the supporting foot
208 the slot A
209 the blocking foot
210 the steel panel
211 the trapezoid groove
212 the embossing belt A
213 the threaded hole
214 the hexagon hole
401 the U-shaped channel
501 the hexagon head
502 the steel wire rope
503 the handle The figures are not intended to be exhaustive or to limit the invention to the precise form disclosed. It should be understood that the invention can be practiced with modification and alteration, and that the invention be limited only by the claims and the equivalents thereof.

DETAILED EMBODIMENTS OF THE INVENTION

From time-to-time, the present invention is described herein in terms of example environments. Description in terms of these environments is provided to allow the various features and of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention, in some embodiments thereof, relates to clamping system for mounting glass balustrade:

Embodiment 1

As shown in FIG. 1 to FIG. 14, the invention comprises a base 4 with U-shaped channel 401, an adjusting component A1 and an adjusting component B2. The adjusting component A1 comprising: an L-shaped Plate 101 with an arc groove inside, fitting for an arc panel 102; an arc panel 102 with longer arc-length than that of the arc groove in the L-shaped Plate 101. The adjusting component A1 further comprises a slide-way 105 situated on both sides of the arc groove in the L-shaped plate 101 and a slot B 107 located beside each end of the slide-ways 105; a sliding block 106 in the middle of both sides of the arc panel 102, which matches with the slide-way 105; insert plates 108 fitting for slots B107, making the L-shaped plate 101 and the arc panel 102 jointly held together by inserting into the slot B 107. The arc panel 102 embedded into the L-shaped plate 101 can slide up and down freely, without the sliding away from the arc groove. The adjusting component B2 comprising: a supporting plate 201 with a trapezoid groove 211 inside; a wedge A203, a wedge B204 and an adjusting bolt 202; a hole channel 206 on the middle top of the supporting plate 201, reaching through the trapezoid groove 211 with a locating element 205 in the middle; both the wedge A203 and the wedge B204, with one plane side and another bevel side, as single-side wedge structure; a threaded hole in the middle of the wedge A203, which has internal thread matching with the adjusting bolt 202; the Wedge B204 comprises a slot A208 in the middle of the bottom part. The adjusting bolt 202, with top part through the threaded hole of the wedge A203, screws together with the wedge A203, with the blocking foot 209 at the end, which fits with the slot A208, connects with the wedge B204 by assembling the blocking foot 209 and the slot A208. An embossing belt A212 on the two bevel surfaces of the trapezoid groove 211, paralleling to the center line of the trapezoid groove 211, symmetrical about the center line.

Figure 11A:
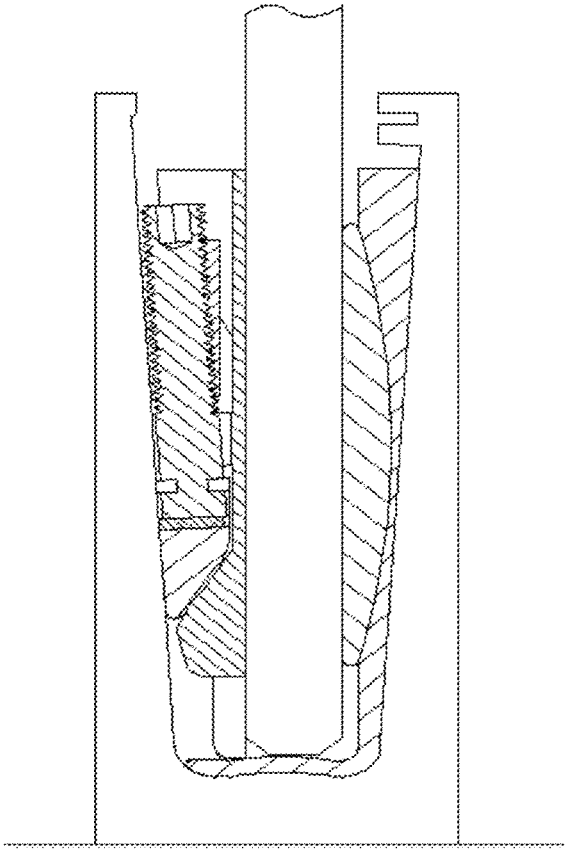
FIG. 11*a*, FIG. 11*b* and FIG. 11*c* are the schematic illustrations of angling of the glass, according to some embodiments of the present invention.
Figure 11B:
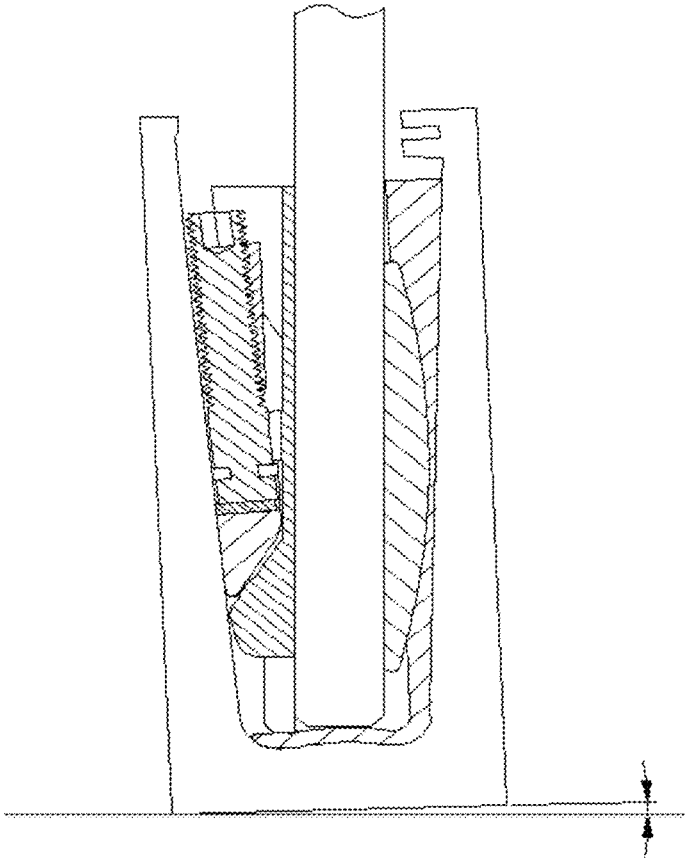
Figure 11C:
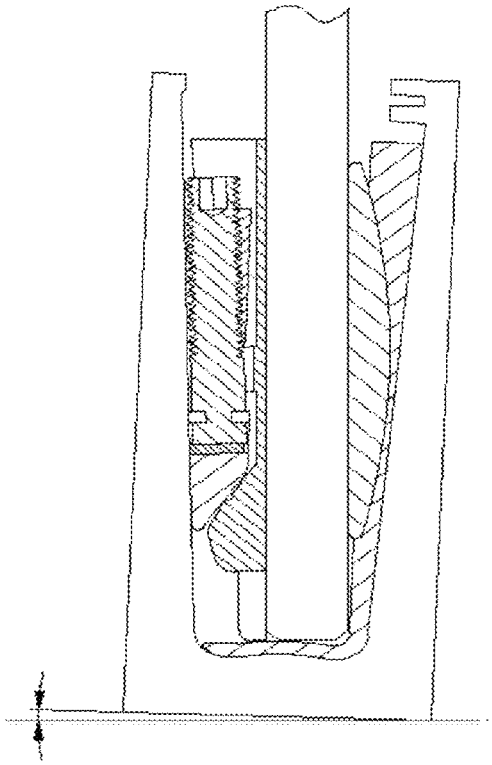
Figure 12:
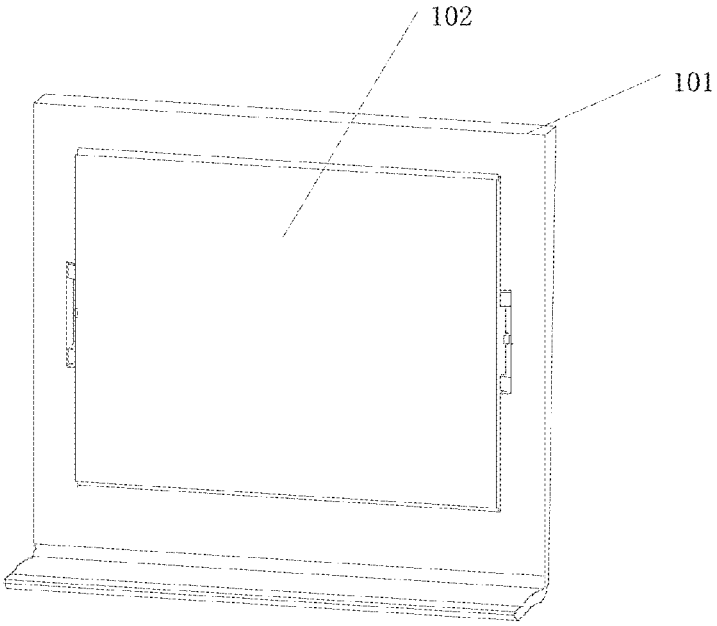
FIG. 12 is the other schematic illustration of the adjusting component A, according to some embodiments of the present invention.
Figure 13:
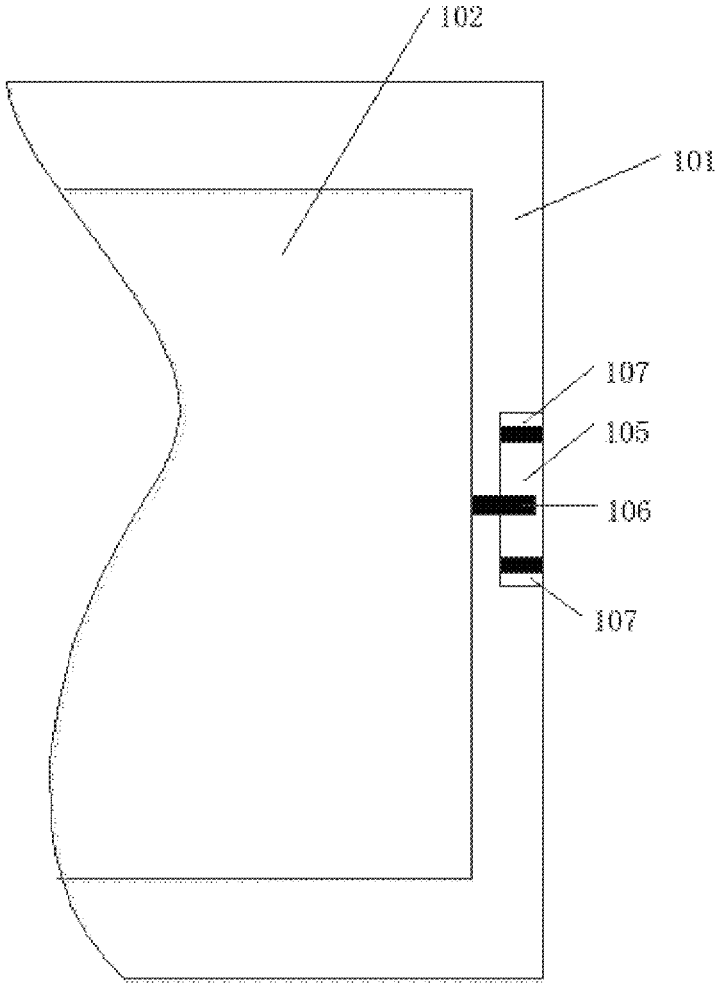
FIG. 13 is the schematic illustration of the joint part of the L-shaped plate and the arc panel, according to some embodiments of the present invention.
Figure 14:
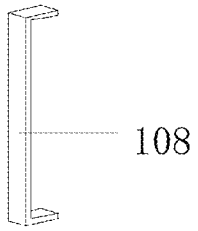
FIG. 14 is the schematic illustration of the insert plates, according to some embodiments of the present invention.

The working process of the invention is stated as below, as shown in FIG. 11*a*-11*c:*

When installing the glass 3 balustrade, the adjusting component A1 is put into the fixed U-shaped channel 401, making the L-shaped plate 101 against the wall of the U-shaped channel 401. Then the glass 3 is put inwards, making the glass 3 against the plane surface of arc panel 102 completely. Then the magnet and the magnetic spirit level are attached to each side of the glass 3 for the use of observing the horizontal plane. The glass 3 is angled to keep vertical with horizontal plane, by the measure of sliding the arc panel 102 which is clung to the glass in the arc groove. Then the adjusting component B2 is put inside. By wresting the wrench and making the adjusting bolt 202 rotated clockwise, the wedge A203 and the wedge B204 make backwards movement, and then the thickness of the adjusting component B2 is enhanced till it can fasten the glass 3. The wedge A203 and wedge B204 only contact with the embossing belt A212 on the bevel surface of the trapezoid groove 211, therefore the pressure from the wedge A203 and wedge B204 during their moving can only apply to the embossing belt A212 which located symmetrically with the center line of the trapezoid groove 211. During the backwards movement of wedge A203 and wedge B204, the force point doesn't change with the movement of wedge A203 or wedge B204, and thus it can guarantee the force delivered from the glass 3 to the arc panel 102 keeping balance, which can prevent the arc panel 102 from sliding due to the asymmetrical force bearing.

When dismounting of the glass 3 balustrade, by twisting the adjusting bolt 202 anticlockwise, the wedge A203 and the wedge B204 make the opposite movement, and then the thickness of the adjusting component B2 is reduced to unfix and release the glass 3.

Embodiment 2

Except for the differences listed as below, others are the same as the embodiment 1.

Figure 7:
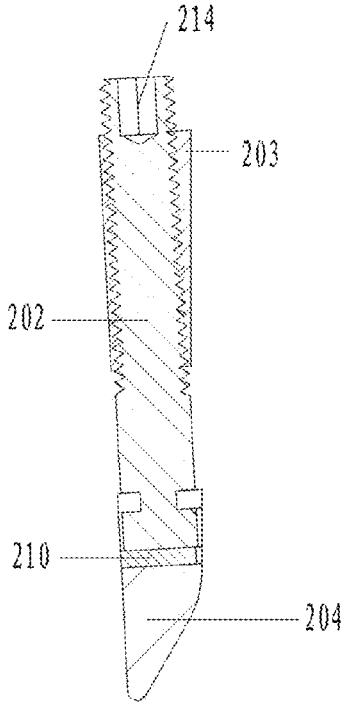
FIG. 7 is the section view of part of the FIG. 1.
Figure 8:
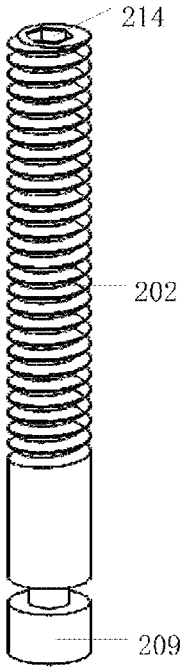
FIG. 8 is the schematic illustration of the adjusting bolt, according to some embodiments of the present invention.
Figure 9:
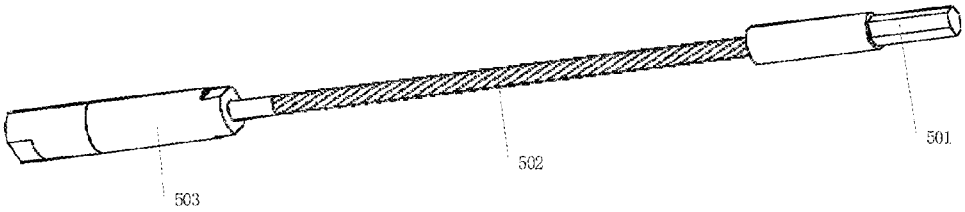
FIG. 9 is the schematic illustration of the hexagon wrench, according to some embodiments of the present invention.
Figure 10:
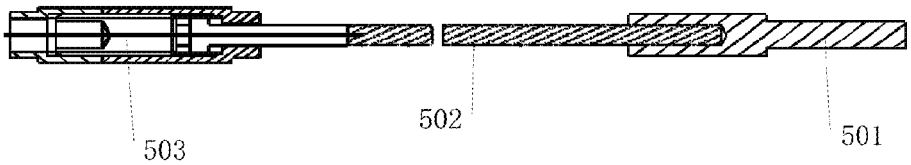
FIG. 10 is the section view of FIG. 9.

As shown in FIG. 7 and FIG. 8, a hexagon hole 214 is on the top of the adjusting bolt 202.

In order to fit with the utilization of the adjusting bolt 202, the inventor designed a special kind of hexagon wrench 5. The structure of the hexagon wrench is shown in the drawing 9-10. The hexagon wrench comprises a hexagon head 501, a steel wire rope 502 and a handle 503. One end of the steel wire rope 502 is fixed with the hexagon head 501, and the other end is fixed with the handle 503. When in use, the interspace between the walls of the U-shaped channel 401 and the glass 3 is very narrow, and the revolving angle of the usual wrench is limited, but this wrench steel wire rope 502 has much flexibility, so that it can curve to a certain angle and then do the spinning, and in this way the limits of the revolving angle is avoided. But the wrench is usually used for eliminating the idle running of the adjusting bolt 202. The wrench limits the value of the maximum torque, and it will idle when it reaches the maximum torque value.

Embodiment 3

Except for the differences listed as below, others are the same as the embodiment 1.

Figure 3:
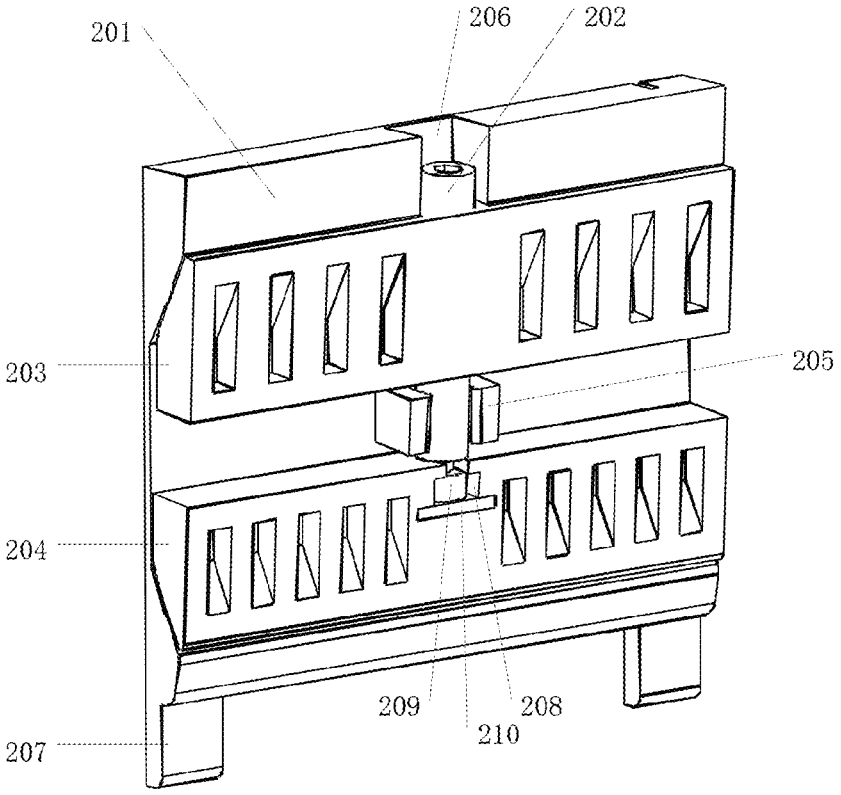
FIG. 3 is the schematic illustration of the adjusting component B, according to some embodiments of the present invention.
Figure 4:
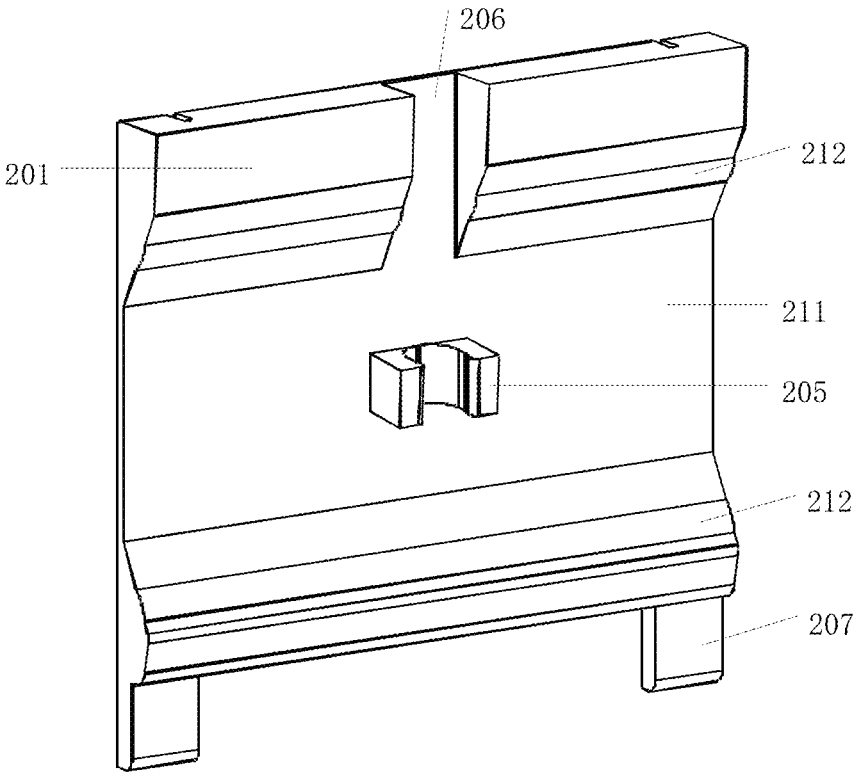
FIG. 4 is the schematic illustration of the supporting plate, according to some embodiments of the present invention.
Figure 5:
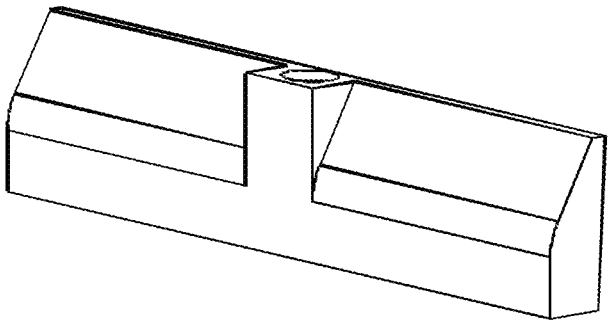
FIG. 5 is the schematic illustration of the wedge A, according to some embodiments of the present invention.

As shown in FIG. 3 and FIG. 4, supporting feet 207 is situated at the bottom of the supporting plate 201.

Embodiment 4

Except for the differences listed as below, others are the same as the embodiment 1.

Figure 6:
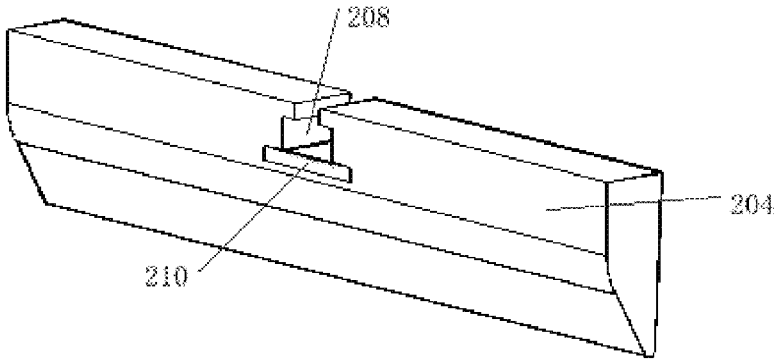
FIG. 6 is the schematic illustration of the wedge B, according to some embodiments of the present invention.

As shown in FIG. 3 and FIG. 6, a steel panel 210 is put at the bottom of the groove A 208. And the function of the steel panel 210 is to increase the hardness of the bottom of the groove A 208.

Embodiment 5

Except for the differences listed as below, others are the same as the embodiment 1.

As shown in FIG. 4 the locating element 205 has a groove, of which width is slightly bigger than the outer diameter of the adjusting bolt 202, where the adjusting bolt 202 is put in. On one hand, the locating element 205 can fix the adjusting bolt 202. On the other hand, it can also avoid the contact of the wedge A203 and the wedge B204, when one of them locks and the other one keeps moving, during their opposite movement.

Embodiment 6

Except for the differences listed as below, others are the same as the embodiment 1.

Figure 2:
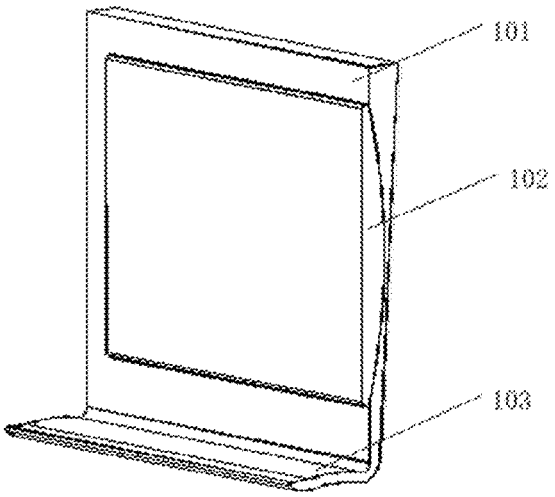
FIG. 2 is one of the schematic illustrations of the adjusting component A, according to some embodiments of the present invention.

As shown in FIG. 1 and FIG. 2, a drain hole 104 for draining water is below the bottom of the L-shaped plate 101.

Embodiment 7

Except for the differences listed as below, others are the same as the embodiment 1.

As shown in FIG. 2, the bottom of the L-shaped plate 101 is configured an arc embossing belt B103, which has the function to facilitate the slide of the glass 3 bottom on the L-shaped plate 101 during angling the glass 3.

Embodiment 8

Except for the differences listed as below, others are the same as the embodiment 1.

As shown in FIG. 3, the L-shaped plate 101, the supporting plate 201, the wedge A203 and the wedge B204, are all designed with process tanks, which can facilitate the casting and processing, as well as save the materials and reduce the cost.

Embodiment 9

Figure 15:
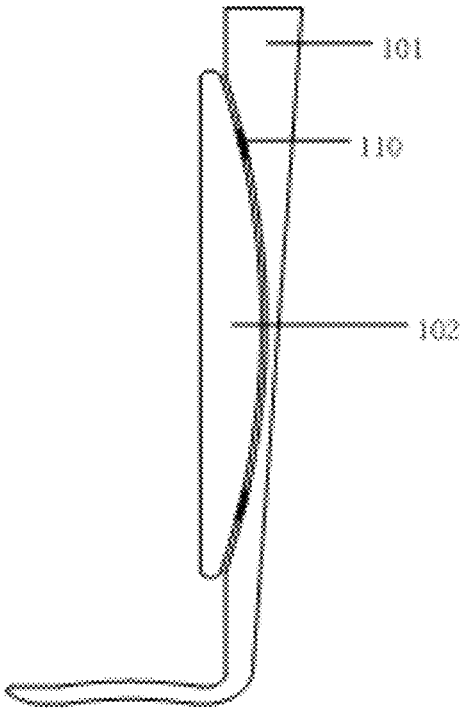
FIG. 15 is one of the schematic illustrations of the Embodiment 9.
Figure 16:
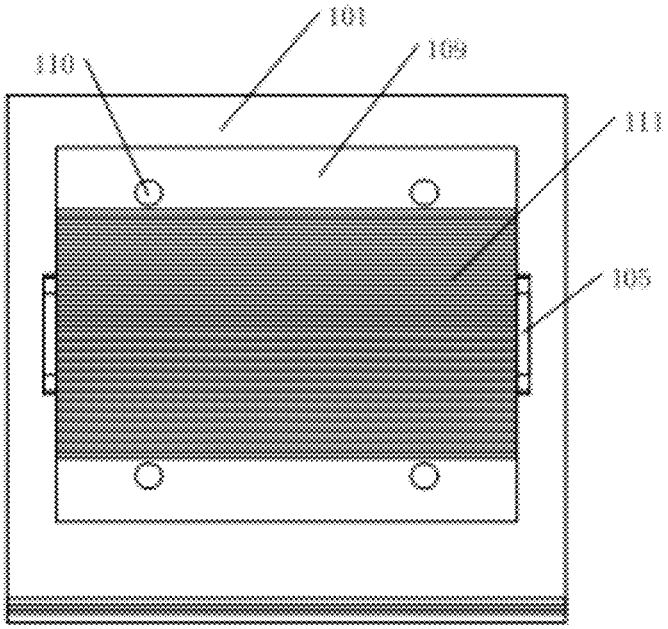
FIG. 16 is the schematic illustration of the L-shaped plate in Embodiment 9.
Figure 17:
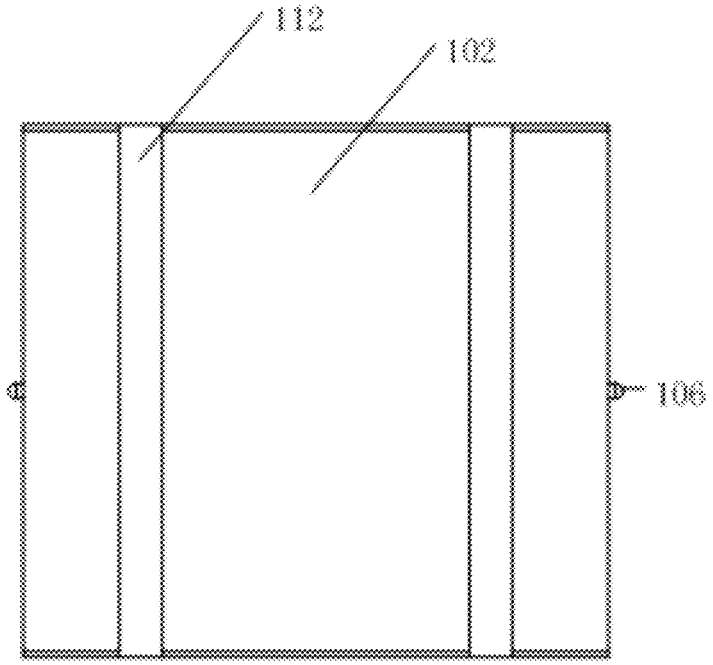
FIG. 17 is the schematic illustration of the arc panel in Embodiment 9.

As shown in FIG. 15-17, except for the differences listed as below, others are the same as the embodiment 1.

A friction tape 111 inside of the arc groove 109 of the L-shaped plate 101, elastic elements 110 on both sides of the friction tape 111 in the arc groove 109, flutes 112 on the back of the arc panel 102 matching with the elastic elements 110

During use, the elastic elements 110 on the L-shaped plate 101 embed in the flutes 112 of the arc panel 102, suspending the arc panel 102 on the surface of arc groove 109. When the glass is put against the arc panel 102, the arc panel 102 finds its position automatically and contacts the friction tape 111 on the surface of the arc groove 109 under the pressure occurred by the glass, the arc panel 102 is fastened with the L-shaped plate 101 under the function of friction. The adjusting component B2 is installed by the other side of the glass, fastening the whole system.

What is claimed is:

1. A clamping system for mounting a glass balustrade, comprising:

a base with a U-shaped channel (401) having a bottom wall and opposing side walls;

an adjusting component A (1) comprising:

an L-shaped plate (101) with an arc groove (109) along an inner surface of a long arm of the plate (101) receiving an arc panel (102) having a convex edge of the arc panel (102) whose length exceeds that of a concave edge of the arc groove (109), an outer surface of the long arm lining one of the side walls of the channel, and a short arm of the L-shaped plate lining the bottom wall of the channel;

an adjusting component B (2) comprising:

a supporting plate (201) having an outer wall configured to engage a glass balustrade and having an outer surface with a trapezoid groove (211) comprising opposing upper and lower beveled surfaces;

a wedge A (203) having a beveled surface engaging the upper beveled surface of the trapezoidal groove and an outer surface engaging the other side wall of the channel;

a wedge B (204) having a beveled surface engaging the lower beveled surface of the trapezoidal groove and an outer surface engaging the other side wall of the channel;

an adjusting bolt (202); and a hole channel (206) reaching from a middle of the supporting plate (201), through the trapezoid groove (211) and a locating element (205) disposed within the trapezoidal groove, when joined together, the wedge A (203), the wedge B (204) and the supporting plate (201) are configured to have one planar side and another beveled side aligned as a single-side wedge structure, and are connected by an adjusting bolt (202) screwed through a threaded hole (213) in a middle of the wedge A (203) and the wedge B (204); and one embossing belt A (212) on each of the opposing beveled surfaces of the trapezoid groove (211), parallel to the a horizontal center line of the trapezoid groove (211); and while assembled, a glass balustrade rests on the short arm of the plate (101) inside of the channel (401), sandwiched between a flat surface of the arc panel (102)

from the adjusting component A (1), and the planar side of the supporting plate (201) from the adjusting component B (2).

2. A clamping system for mounting a glass balustrade of claim 1, wherein the L-shaped plate (101) further comprises:

a slide-way (101) situated on both sides of the arc groove in the L-shaped plate (101) of the adjusting component A (1) and a slot B (107) located beside each end of the slide-ways (105);

a sliding block (106) in the middle of both sides of the arc panel (102) configured to match the each slide-way (105); and two insert plates (108) fitted for the slot B (107) to cover the slide-ways (105).

3. A clamping system for mounting a glass balustrade of claim 2, further comprising a slot A (208) in a bottom section of the wedge B (204) configured to receive a blocking foot (209) at the end of the adjusting bolt (202).

4. A clamping system fox mounting a glass balustrade of claim 2, wherein the supporting plate (201) further comprises two supporting feet (207) at the bottom.

5. A clamping system for mounting a glass balustrade of claim 2, wherein the supporting plate (201) further comprises a groove on the locating element (205), spaced slightly wider than the outer diameter of the adjusting bolt (202) to allow the adjusting bolt (202) to settle in.

6. A clamping system for mounting a glass balustrade of claim 2, wherein the L-shaped plate (101) further comprises:

a friction tape (111) inside of the arc groove of the L-shaped plate (101);

elastic elements (110) on both sides of the friction tape in the arc groove; and flutes(112) on a back of the arc panel (102) configured to match the elastic elements.

7. A clamping system for mounting a glass balustrade of claim 1, further comprising a slot A (208) in a bottom section of the wedge B (204) configured to receive a blocking foot (209) at the end of the adjusting bolt (202).

8. A clamping system for mounting a glass balustrade of claim 1, wherein the supporting plate (201) further comprises two supporting feet (207) at the bottom.

9. A clamping system for mounting a glass balustrade of claim 1, wherein the supporting plate (201) further comprises a groove on the locating element (205) spaced slightly wider than the outer diameter of the adjusting bolt (202) to allow the adjusting bolt (202) to settle in.

10. A clamping system for mounting glass balustrade partitions comprising multiple clamping units, wherein each clamping unit comprises:

a base with a U-shaped channel (401) having a bottom wall and opposing side walls;

an adjusting component A (1) comprising:

an L-shaped plate (101) with an arc groove (109) along an inner surface of a long arm of the plate (101) receiving an arc panel (102) having a convex edge of the arc panel (102) whose length exceeds that of a concave edge of the arc groove (109), an outer surface of the long arm lining one of the side walls of the channel, and a short arm of the L-shaped plate lining the bottom wall of the channel;

an adjusting component B (2) comprising:

a supporting plate (201) having an outer wall configured to engage a glass balustrade and having an outer surface with a trapezoid groove (211) comprising opposing upper and lower beveled surfaces;

a wedge A (203) having a beveled surface engaging the upper beveled surface of the trapezoidal groove and an outer surface engaging the other side wall of the channel;

a wedge B (204) having a beveled surface engaging the lower beveled surface of the trapezoidal groove and an outer surface engaging the other side wall of the channel;

an adjusting bolt (202); and a hole channel (206) reaching from a middle of the supporting plate (201), through the trapezoid groove (211) and a locating element (205) disposed within the trapezoidal groove, when joined together, the wedge A (203), the wedge B (204) and the supporting plate (201) are configured to have one planar side and another beveled side aligned as a single-side wedge structure, and are connected by an adjusting bolt (202) screwed through a threaded hole (213) in a middle of the wedge A (203) and the wedge B (204); and one embossing belt A (212) on each of the opposing beveled surfaces of the trapezoid groove (211), parallel to the a horizontal center line of the trapezoid groove (211); and while assembled, a glass balustrade rests on the short arm of the plate (101) inside of the channel (401), sandwiched between a flat surface of the arc panel (102) from the adjusting component A (1), and the planar side of the supporting plate (201) from the adjusting component B (2).

* * * * *